US006145169A

United States Patent [19]

Terzuola et al.

[11] Patent Number: 6,145,169

[45] Date of Patent: Nov. 14, 2000

[54] LOCKING, REMOVABLE BELT CLIP

[75] Inventors: Robert G. Terzuola, Santa Fe, N. Mex.; Timothy B. Wegner, Puyallup, Wash.

[73] Assignee: Wegner Design and Development, LLC, Puyallup, Wash.

[21] Appl. No.: 09/352,452

[22] Filed: Jul. 13, 1999

[51] Int. Cl.[7] ..... A44B 11/25

[52] U.S. Cl. ..... 24/170; 24/163 K; 24/191; 24/543

[58] Field of Search ..... 24/170, 190, 191, 24/163 K, 186, 198, 543

[56] References Cited

U.S. PATENT DOCUMENTS

| | | | |
|---|---|---|---|
| 267,526 | 11/1882 | Herzog . | |
| 1,578,468 | 3/1926 | Rankin . | |
| 2,271,133 | 1/1942 | Thoresen | 24/170 |
| 2,551,515 | 5/1951 | Tschirf . | |
| 3,818,548 | 6/1974 | Meyerson . | |
| 3,927,442 | 12/1975 | Foster . | |
| 4,113,157 | 9/1978 | Woodbury . | |
| 4,326,280 | 4/1982 | Perry, Jr. . | |
| 4,387,489 | 6/1983 | Dudek . | |
| 4,604,772 | 8/1986 | Arff | 24/170 |
| 5,201,099 | 4/1993 | Campbell | 24/186 |

FOREIGN PATENT DOCUMENTS

| | | | |
|---|---|---|---|
| 2038917 | 7/1980 | United Kingdom | 24/170 |

*Primary Examiner*—Victor N. Sakran
*Attorney, Agent, or Firm*—Robert D. Varitz, PC

[57] ABSTRACT

A belt clip for supporting an object on a user's belt includes an inward portion for insertion between the user's belt and body, having a first hinge portion on one edge thereof and including a pair of spaced-apart, flexible wings located at the other edge thereof, wherein each wing has a first locking structure thereon; an outward portion for attaching an object thereto, having a second hinge portion thereon and having a second locking structure thereon; and a hinge pin for joining said first hinge portion and said second hinge portion together in a moveable condition.

10 Claims, 1 Drawing Sheet

LOCKING, REMOVABLE BELT CLIP

FIELD OF THE INVENTION

This invention relates to belt clips for carrying objects on a user's belt, and specifically to a belt clip which locks in place, may be easily unlocked and removed, and which will carry an object in a desired orientation.

BACKGROUND OF THE INVENTION

A wide variety of belt clips are known. The primary purpose, of course, of a belt clip is to allow a user to attach an object to the user's belt. "Belt," as used herein, may mean the conventional belt that is used in conjunction with belt loops on a user's pants, and is primarily intended to hold the pants about the user's waist, or it may refer to a utility belt or harness which is worn for the sole purpose of carrying a number of objects.

In it's most basic form a belt clip may include a folded metallic spring with an object attached to one fold thereof, wherein the spring simply slips over the users belt. More complex belt clips may include a locking mechanism.

A significant problem with many known belt clips is that the belt clip fails to maintain the carried object in a specific orientation. In the case of military or law enforcement personnel, the carried object may include a holster for a firearm, a sheath for a knife, handcuffs, chemical deterrence, flashlights, etc. Such objects must be readily available to the user who will frequently reach for the object in an instinctive fashion. If the mechanism holding the object to the user's belt has allowed the object to shift position, the user may not be able readily to grasp the object when needed.

A number of prior art clips are known. Herzog, U.S. Pat. No. 267,526, Nov. 14, 1882, discloses a slide for chain bracelets and other chains which provides a fastening mechanism for a chain bracelet and which maintains orientation relative to the bracelet by being specifically sized to the bracelet.

Rankin, U.S. Pat. No. 1,578,468, Mar. 30, 1926, discloses a belt buckle which incorporates a matchbox therein, and which is moveable along the length of a belt. Again, orientation relative to the belt is maintained by sizing a clip for the belt buckle to the specific width of the belt.

Tschirf, U.S. Pat. No. 2,551,515, May 1, 1951, discloses a device designed to hold a watch on a belt. A conventional wristwatch is held on the device by means of pins which are forced apart by a spring. This is the same type of mechanism that is used to secure a watchband to a watch. The device clamps over the wearer's belt and is held in place by means of a clamping lever. There is no specific mechanism to maintain orientation of the holding device relative to the belt.

Meyerson, U.S. Pat. No. 3,818,548, Jun. 25, 1974, discloses a belt buckle, which may also be used to secure an object to a belt, and which clamps to a belt, thereby maintaining orientation relative to the belt.

Foster, U.S. Pat. No. 3,927,442, Dec. 23, 1975, discloses a belt buckle which is designed to carry credit cards therein. The belt buckle features a hinged structure, which forms a compartment in the buckle. Woodbury, U.S. Pat. No. 4,113,157, Sep. 12, 1978, discloses a buckle having receptacles therein for coins, keys and other objects. The buckle is intended to be placed between the ends of a belt web, and thus maintains its position relative to the web of the belt.

Perry, Jr., U.S. Pat. No. 4,326,280, Apr. 20, 1982, discloses a watch mounting device which is used to hold a watch on a belt and which incorporates a spring loaded cover and a fastening mechanism for the watch. The device is held on the belt by means of conventional belt loops and, if placed on a belt that is substantially narrower than the belt loops, will not maintain orientation on the belt web.

Dudek, U.S. Pat. No. 4,387,489, Jun. 14, 1983 discloses a medical device which provides a lock for a ligature loop. The clasp includes two portions which are hinged to one another and which include a locking mechanism to hold the two portions together in a closed condition.

SUMMARY OF THE INVENTION

A belt clip for supporting an object on a user's belt includes an inward portion for insertion between the user's belt and body, having a first hinge portion on one edge thereof and including a pair of spaced-apart, flexible wings located at the other edge thereof, wherein each wing has a first locking structure thereon; an outward portion for attaching an object thereto, having a second hinge portion thereon and having a second locking structure thereon; and a hinge pin for joining said first hinge portion and said second hinge portion together in a moveable condition.

An object of the invention is to provide a belt clip which is easily removable from a user's belt.

Another object of the invention is to provide a belt clip which will lock in place on a user's belt.

A further object of the invention is to provide a belt clip which will maintain an object, secured thereto, in a specific orientation relative to the webbing of the belt.

Still another object of the invention is to provide a belt clip which will maintain a desired orientation relative to the belt webbing regardless of the width of the belt webbing.

These and other objects of the invention will become more fully apparent as the description which follows is read in conjunction with the drawings.

DETAILED DESCRIPTION OF THE PREFERRED EMBODIMENTS

Figure 1:
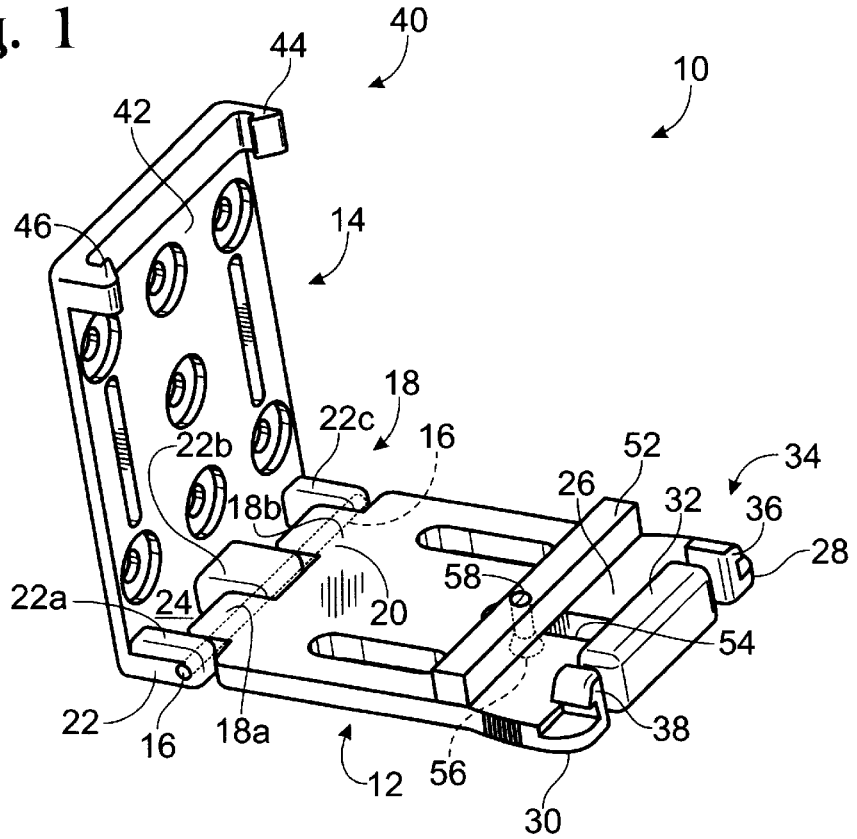
FIG. 1 is a perspective view of the belt clip of the invention in an open condition.
Figure 2:
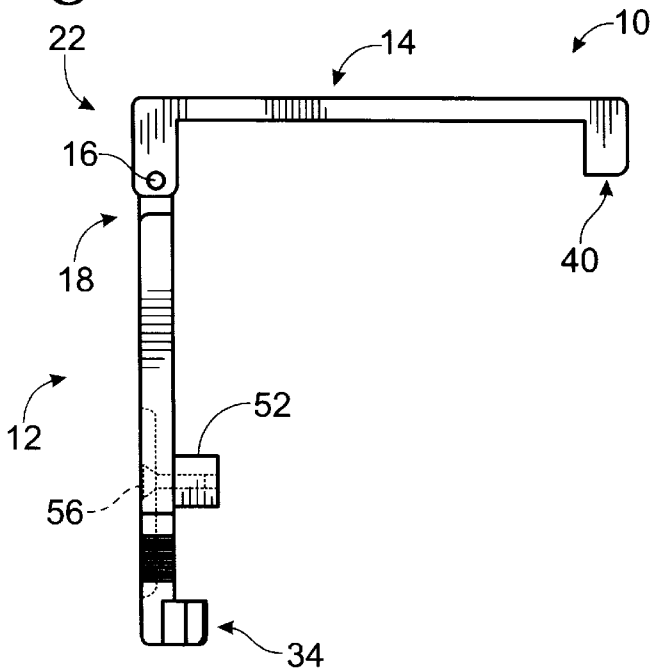
FIG. 2 is a side elevation of the belt clip of FIG. 1.

Referring initially to FIG. 1, the belt clip of the invention is depicted generally at 10 in an open condition. Clip 10 includes two hinged portions, including an inward portion 12 and an outward portion 14. The two portions are held together by a pair of, in the preferred embodiment, hinge pins 16, which cooperate with a first hinge portion 18 located on an upper, one edge 20 of inward portion 12, including first hinge structures 18*a* and 18*b*, and a second hinge portion 22, which is located at one end 24 of outward portion 14, and which includes second hinge structures 22*a*, 22*b*, and 22*c*, which extend laterally, outwardly relative to outward portion 14. The first and second hinge portions are interleaved with one another to complete the hinge mechanism.

Inward portion 12 includes a central expanse 26 which is located between a pair of spaced-apart, flexible wings 28, 30. Central expanse 26 has a protrusion 32 located there on it the free end thereof, which extends outwardly from the central expanse.

A locking mechanism for built clip 10 includes a first locking structure, shown generally at 34, located at another edge of inward portion 12, and which includes barbed flanges 36, 38, located on wings 28, 30, respectively, and which project laterally, outwards from inward portion 12. Protrusion 32 and flanges 36, 38 form a ridge along the lower edge of inward portion 12, which ridge serves as a captureing mechanism along the other edge thereof, forming a closed, web-receiving region within clip 10 when the clip is in its closed condition.

Figure 3:
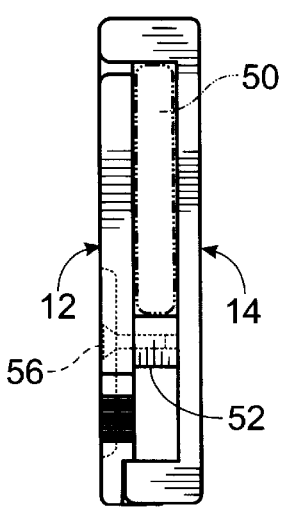
FIG. 3 is a side elevation of the belt clip in a closed condition, shown in an environmental view.

A second locking structure 40 is located at the other edge 42 of outward portion 14. Second locking structure 40 also includes a pair of spaced-apart barbed flanges 44, 46 which meet with and capture barbed flanges 36, 38 respectively, thereby locking clip 10 in a closed condition, as shown in FIG. 3. In the preferred embodiment, barbed flanges 36, 38 face outwards towards the sides of inward portion 12, while barbed flanges 44, 46 face inwards from the sides of outward portion 14. The clip is configured to its closed, locked condition merely by squeezing inward portion and outward portion together adjacent their free and other edges, respectively. In order to release the clip, wings 28, 30 are squeezed toward central expanse 26, thus disengaging barbed flanges 36,38 from barbed flanges 44, 46, respectively.

Referring again to FIG. 3, a belt web 50 is depicted as being captured within belt clip 10. As previously noted, web 50 may be applied to the conventional belt that is used in conjunction with belt loops on a user's pants, or it may refer to a utility belt or harness which is worn for the sole purpose of carrying a number of objects. As is evident from FIG. 3, the web of belt 50 is narrower than the height of clip 10, which would allow clip 10 to rotate on belt 50. To prevent this, a sizing mechanism is provided. The sizing mechanism includes a transversely extending bar 52, which is fixed to inward portion 12. Fixing of bar 52 is accomplished by the provision of a slot 54, or receiver, within central expanse 26 and the insertion of a threaded fastener 56 through slot 54 into an appropriately threaded bore 58 in bar 52. This allows a vertical adjustment of bar 52 relative to inward portion 12, providing adjustability along the length of central expanse 26 to conform to the width of belt 50.

Outward portion 14 is formed with a plurality of wasted areas therein, shown generally at 60, which areas include elongate slots 62, 64 and a number of other areas such as 66, 68 which comprise what is referred to herein as an object receiver, and which allows attachment of a number of objects to belt clip 10. An object may be attached to clip 10 in a specific orientation, which orientation will be maintained when clip 10 is securred to a user's belt.

Thus, a belt clip has been disclosed which is easily fixed and removed from a user's belt, which is adjustable to the width of a user's belt, and which will maintain the orientation of an object supported thereby. Although a preferred embodiment of the invention has been disclosed herein, it will be appreciated that further variations and modifications may be made thereto without departing from the scope of the invention as defined in the appended claims.

We claim:

1. A belt clip for supporting an object on a user's belt, comprising:

an inward portion for insertion between the user's belt and body, having a first hinge portion on one edge thereof and including a pair of spaced-apart, flexible wings located at the other edge thereof, wherein each wing has a first locking structure thereon;

an outward portion for attaching an object thereto, having a second hinge portion thereon and having a second locking structure thereon; and a hinge pin for joining said first hinge portion and said second hinge portion together in a moveable condition; wherein said first hinge portion includes first hinge structures located on said inward portion and wherein said second hinge portion includes second hinge structures extending laterally outwardly relative to said outward portion, and wherein said first hinge structures are interleaved with said second hinge structures.

2. The belt clip of claim 1 wherein said first locking structure includes a barbed flange located adjacent a free end of each wing, wherein said flange projects laterally outwards from said inward portion, and wherein said second locking structure includes a pair of spaced-apart barbed flanges constructed and arranged to mate with and capture the flanges of said first locking structure.

3. The belt clip of claim 1 wherein said inward portion includes a central expanse located between said spaced-apart flexible wings, wherein said central expanse includes a protrusion extending outwardly therefrom at the free end thereof, and wherein said protrusion and said first locking structure form a ridge along a lower edge of said inward portion.

4. The belt clip of claim 3 wherein said central expanse further includes a receiver for a sizing mechanism, wherein said sizing mechanism is adjustable along a portion of the length of said central expanse to conform to a user's belt width.

5. The belt clip of claim 1 wherein said outward portion includes a plurality of wasted areas therein comprising said object receiver.

6. A belt clip for supporting an object on a user's belt, comprising:

an inward portion for insertion between the user's belt and body, having a first hinge portion on one edge thereof and including a pair of spaced-apart, flexible wings located at the other edge thereof, wherein each wing has a first locking structure thereon;

an outward portion for attaching an object thereto, having a second hinge portion thereon and having a second locking structure thereon;

wherein said first locking structure includes a barbed flange located adjacent a free end of each wing, wherein said flange projects laterally outwards from said inward portion, and wherein said second locking structure includes a pair of spaced-apart barbed flanges constructed and arranged to mate with and capture the flanges of said first locking structure; and a hinge pin for joining said first hinge portion and said second hinge portion together in a moveable condition.

7. The belt clip of claim 6 wherein said first hinge portion includes first hinge structures located on said inward portion and wherein said second hinge portion includes second hinge structures extending laterally outwardly relative to said outward portion, and wherein said first hinge structures are interleaved with said second hinge structures.

8. The belt clip of claim 6 wherein said inward portion includes a central expanse located between said spaced-apart flexible wings, wherein said central expanse includes a protrusion extending outwardly therefrom at the free end thereof, and wherein said protrusion and said first locking structure form a ridge along a lower edge of said inward portion.

9. The belt clip of claim 8 wherein said central expanse further includes a receiver for a sizing mechanism, wherein said sizing mechanism is adjustable along a portion of the length of said central expanse to conform to a user's belt width.

10. The belt clip of claim 6 wherein said outward portion includes a plurality of wasted areas therein comprising said object receiver.

* * * * *